US008334664B2

(12) United States Patent
Lai

(10) Patent No.: US 8,334,664 B2
(45) Date of Patent: Dec. 18, 2012

(54) LIGHT EMITTING DIODE ILLUMINATING SYSTEM AND CONTROL METHOD THEREOF

(75) Inventor: Chih-Chen Lai, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 456 days.

(21) Appl. No.: 12/774,803

(22) Filed: May 6, 2010

(65) Prior Publication Data

US 2011/0156594 A1 Jun. 30, 2011

(30) Foreign Application Priority Data

Dec. 30, 2009 (TW) ..... 98145725 A

(51) Int. Cl.
*H05B 37/02* (2006.01)

(52) U.S. Cl. ..... 315/308; 315/307; 315/312; 315/192

(58) Field of Classification Search ..... 315/129, 315/130, 185 R, 192, 185 S, 291, 294, 297, 315/299, 307, 308, 312, 361
See application file for complete search history.

(56) References Cited

U.S. PATENT DOCUMENTS

2002/0163514 A1* 11/2002 Nagai et al. ..... 345/204
2002/0195945 A1* 12/2002 Gershen et al. ..... 315/55

* cited by examiner

*Primary Examiner* — Douglas W Owens
*Assistant Examiner* — Jianzi Chen
(74) *Attorney, Agent, or Firm* — Altis Law Group, Inc.

(57) ABSTRACT

A light emitting diode (LED) illuminating system includes a LED illuminating circuitry, which includes a plurality of LEDs connected in parallel, and an actuator connected to the LED illuminating circuitry to actuate the plurality of LEDs. The actuator includes a sensor and a control circuitry, which includes a controller connected to the actuator. The sensor is configured to detect an output signal of the actuator and to output the detected data value to the controller. The controller is configured to compare the detected data value with a predetermined data value, and to output a scan signal to the actuator when a LED is found to be malfunctioning. The actuator is configured to scan each LED and to output a location parameter of the malfunctioning LED to the controller based on the scan signal. A method for controlling the LED lighting system is also provided.

8 Claims, 3 Drawing Sheets

LIGHT EMITTING DIODE ILLUMINATING SYSTEM AND CONTROL METHOD THEREOF

BACKGROUND

1. Technical Field

The present disclosure generally relates to illuminating systems, and particularly, to a light emitting diode illuminating system and a control method thereof.

2. Description of Related Art

Light Emitting Diode (LED) light sources have recently undergone significant advances, which enables them to be a cost effective replacement for conventional light sources. LEDs offer significant benefits over conventional light sources as they consume less electrical energy for a given light intensity while exhibiting much longer life expectancy. Other desirable properties of LEDs include high resistance to shock or vibration, low heat dissipation, very fast switching response times and a wider choice of illuminating colors.

Since LEDs are one-way diodes, their possible arrangements include parallel, series, or series-parallel for Direct Current (DC) systems. In a conventional DC circuit, when one LED in a series fails, the entire series or string fails, and it is time consuming to determine which of the LEDs has failed.

Therefore, an illuminating system and a control method thereof which overcome the described limitations is desired.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION

Figure 1:
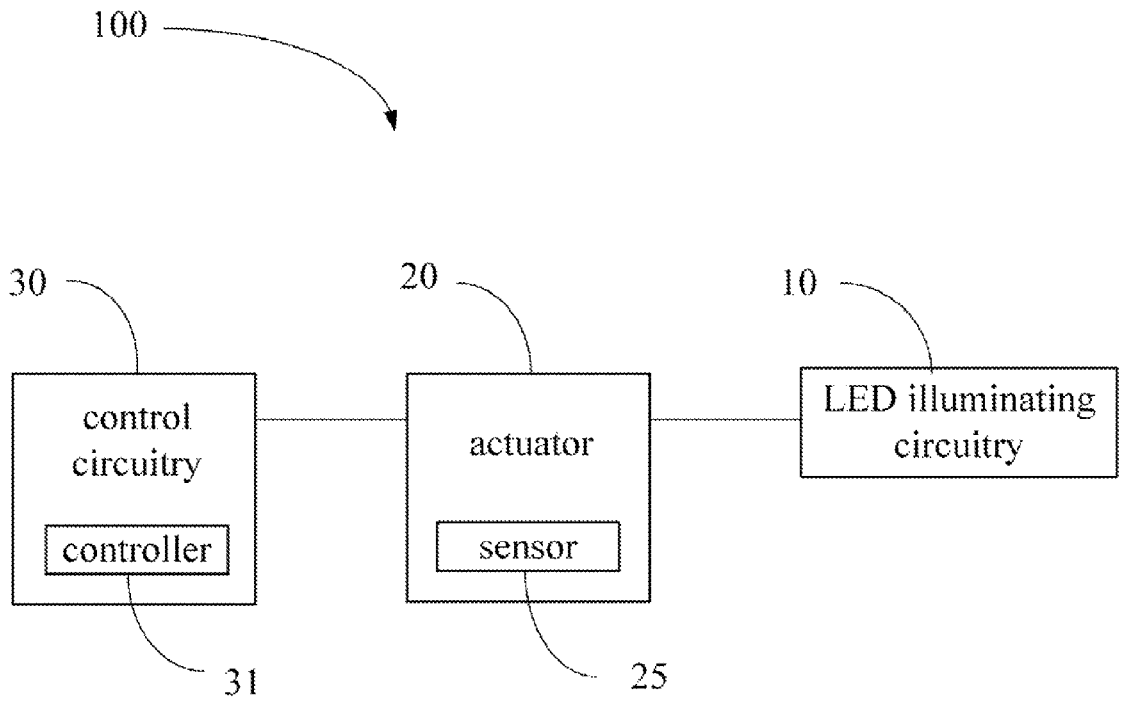
FIG. 1 is a block diagram of one embodiment of an LED illuminating system, the LED illuminating system including LED illuminating circuitry and an actuator.

Referring to FIG. 1, one embodiment of an LED illuminating system 100 as disclosed includes a LED illuminating circuitry 10, an actuator 20 connected to the LED illuminating circuitry 10, and a control circuitry 30 connected to the actuator 20.

Figure 2:
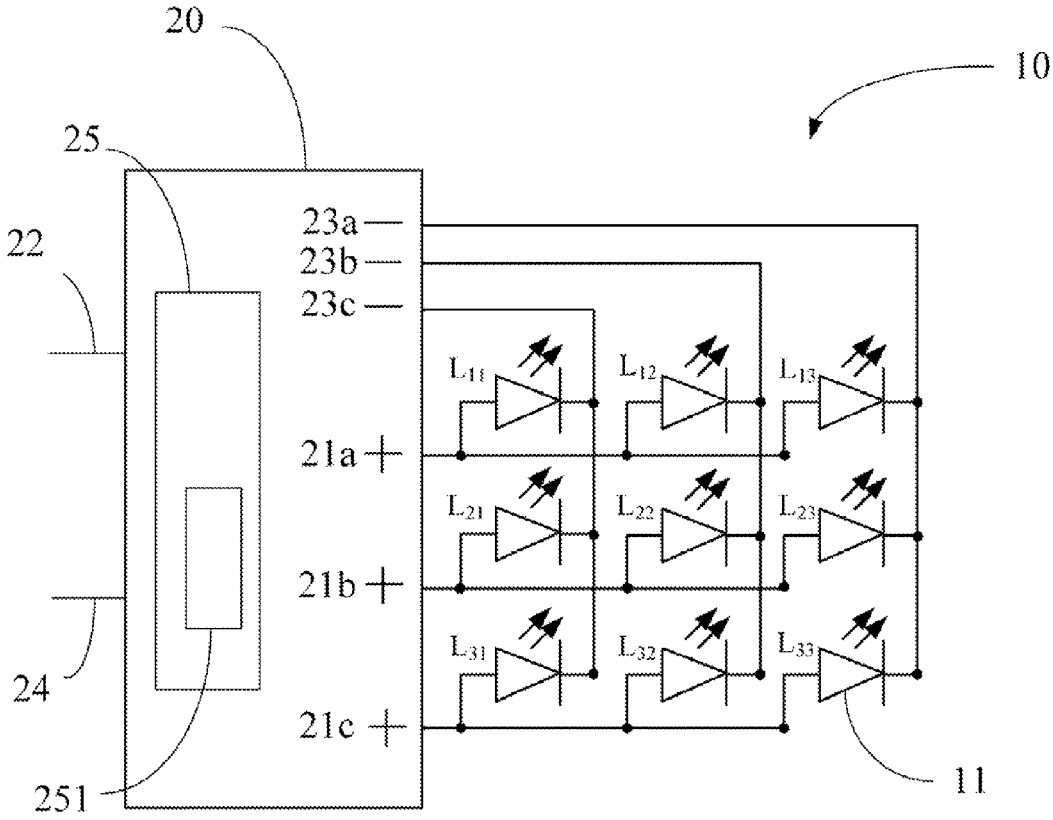
FIG. 2 is an electric diagram of the LED illuminating circuitry and the actuator of FIG. 1.

Referring to FIG. 2, the LED illuminating circuitry 10 includes a plurality of, for example $N^2$, where N is an integer, individual LEDs 11. Each LED 11 includes a positive electrode and a negative electrode. The plurality of LEDs 11 is arranged in a matrix represented by N×N, and are labeled thereafter by $L_{11}, L_{12} \ldots, L_{nm}$. The actuator 20 can actuate the LED illuminating circuitry 10. The actuator 20 includes a plurality of, for example N, positive pins labeled by 21*a*, 21*b*, 21*c*, a plurality of, for example N, negative pins labeled by 23*a*, 23*b*, 23*c*, an input pin 22, and an output pin 24. Each positive electrode of a row of LEDs 11 is connected to the corresponding positive pin, and each negative electrode of a column of LEDs 11 is connected to the corresponding negative pin. Thus, the plurality of LEDs 11 is connected to each other in the matrix, and at least one pin connected to the one LED 11 is different from the pin connected to another LED 11. In a normal operating state, the actuator 20 applies a standard voltage to each pair of positive pins and negative pins to actuate all of the LEDs 11. In the illustrated embodiment, N is configured to 3.

The actuator 20 further includes a sensor 25. The sensor 25 can detect an output signal of the actuator 20 and output the detected data value to the control circuitry 30. The output signal is an analog signal, such as a current signal or a voltage signal. The sensor 25 includes an analog/digital (A/D) converter 251. The analog output signal detected by the sensor 15 is converted to a digital signal by the A/D converter 251 and then transmitted to the control circuitry 30 via the output pin 24.

Referring to FIG. 1 again, the control circuitry 30, for controlling the actuator 20, includes a controller 31 connected to the actuator 20, and is configured to compare the detected data value transmitted by the sensor 25 with a predetermined data value stored in a memory thereof to determine whether a LED 11 is malfunctioning or not. If so, the controller 31 outputs a scan signal to the actuator 20. The actuator 20 then scans each LED 11 upon receiving the scan signal, and outputs a location parameter of the malfunctioning LED 11 to the controller 31 based on the scan results.

Figure 3:
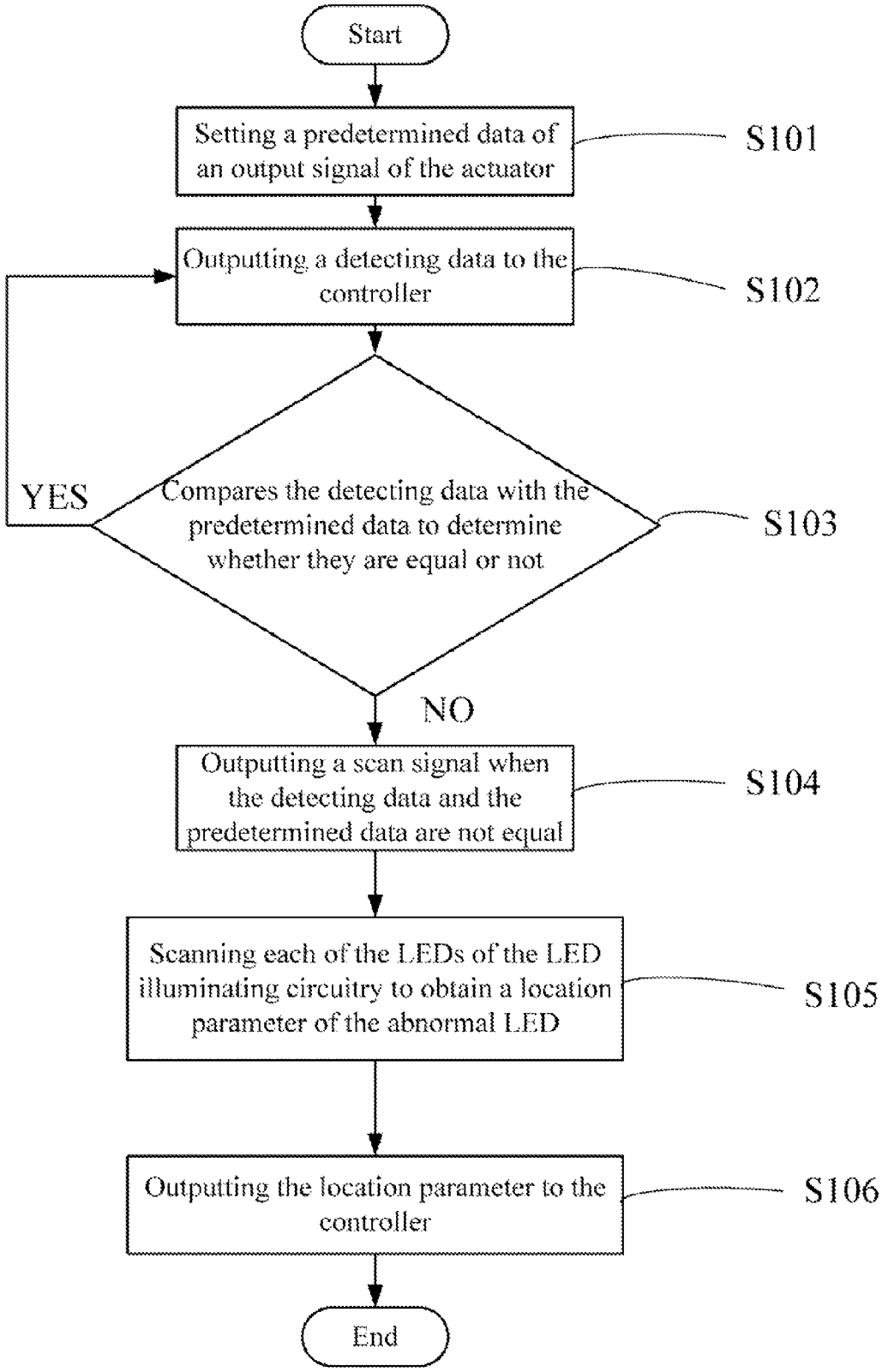
FIG. 3 is a flowchart of one embodiment of a method for controlling the LED illuminating system of FIG. 1.

Referring to FIG. 3, one embodiment of a method for controlling the LED illuminating system 100 follows.

In step S101, the predetermined data value of the output signal of the actuator 20 is set and stored by the memory. The predetermined data value, such as a current or voltage value, may be a constant, or an integer.

In step S102, the control circuitry 30 outputs a control signal to control the actuator 20 via the input pin 22, so as to actuate all of the LEDs 11. At the same time, the sensor 25 monitors the output signal of the actuator 20, and outputs the detected data value to the controller 31 in real time or in intervals.

In step S103, the controller 31 compares the detected data value with the predetermined data value. If the detected data value matches the predetermined data value, step S102 is implemented. When at least one LED 11 becomes open circuit or short circuits, an output signal, such as a current signal or a voltage signal, applied to the LED 11 is malfunctioning. If the detected data value and the predetermined data value do not match, step S104 is implemented.

In step S104, the controller 31 outputs the scan signal to the actuator 20.

In step S105, the actuator 20 scans each LED 11 of the LED illuminating circuitry 10 to obtain a location parameter of the malfunctioning LED 11.

Referring to FIG. 2 again, in this embodiment, the scanning of the LEDs 11 further includes having the actuator 20 applying a constant voltage between one of the positive pins 21*a*, 21*b*, 21*c*, and one of the negative pins 23*a*, 23*b*, 23*c*.

The sensor 25 detects a current of the positive pin and the negative pin.

The actuator 20 continuously applies a constant voltage to another positive pin and another negative pin until each LED 11 is scanned. The sensor 25 can then determine the location parameter of the malfunctioning LED 11. Because one LED 11 is connected to a positive pin and a negative pin, which are different from that of the other LEDs 11, it is possible to determine which one of the LEDs 11 is malfunctioning. For example, LED $L_{11}$ becomes open circuit, if the current of the positive pin 21*a* and the negative pin 23*c* becomes zero; or it may be implied that the LED $L_{22}$ has become short circuit, if the current of the positive pin 21*b* and the negative pin 23*b* are unusually large.

In step S106, the actuator 20 outputs the location parameter of the malfunctioning LED 11 to the controller 31.

The embodiment of the LED illuminating system 100 includes a plurality of LEDs 11 connected in parallel, such that the malfunctioning of one or more LEDs 11 does not interferes with the normal working state of the other LEDs 11. In addition, the location parameter of the malfunctioning LED 11 is easily obtained, thus an improved stability of the LED illuminating system 100 is achieved.

It is to be understood that, in alternative embodiments, N may be configured to 2, 4, or more. The number of the LEDs 11 in the rows does not need to be equal to the number of LEDs 11 in the columns.

It is believed that the present embodiments and their advantages will be understood from the foregoing description, and it will be apparent that various changes may be made thereto without departing from the spirit and scope of the disclosure or sacrificing all of its material advantages.

What is claimed is:

1. A light emitting diode (LED) illuminating system, comprising:

a LED illuminating circuitry comprising a plurality of LEDs connected in a matrix;

an actuator connected to the LED circuitry to actuate the plurality of LEDs, the actuator comprising a sensor; and a control circuitry comprising a controller, and the controller is connected to the actuator, wherein the sensor is configured to detect an output signal of the actuator and output a detected data value to the controller; the controller is configured to compare the detected data value with a predetermined data value stored in the controller, and outputs a scan signal to the actuator when a LED is determined to be malfunctioning; the actuator is configured to scan each LED and to output a location parameter of the malfunctioning LED to the controller based on the scan signal.

2. The LED illuminating system of claim 1, wherein the actuator comprises a plurality of positive pins and a plurality of negative pins; each LED comprises a positive electrode and a negative electrode; each positive electrode of a row of LEDs is connected to the corresponding positive pin; and each negative electrode of a column of LEDs is connected to the corresponding negative pin.

3. The LED illuminating system of claim 2, wherein the number of the positive pins is configured to N, where N is an integer, the number of the negative pins is configured to N, the total number of the LEDs is $N^2$, and the LEDs are arranged in the matrix represented by N×N.

4. The LED illuminating system of claim 1, wherein the output signal of the actuator is an analog signal, the sensor comprises an A/D converter, and the sensor outputs the digital signal to the controller.

5. The LED illuminating system of claim 4, wherein the analog signal is a current signal or a voltage signal.

6. A method for controlling the LED lighting system of claim 1, comprising:

setting the predetermined data value of an output signal of the actuator;

outputting the detected data value to the controller;

comparing the detected data value with the predetermined data value, and outputting a scan signal when the detected data value and the predetermined data value do not match;

scanning each LED of the LED illuminating circuitry to obtain a location parameter of the malfunctioning LED; and outputting the location parameter to the controller.

7. The method of claim 6, wherein the output signal is a current signal or a voltage signal.

8. The method of claim 6, wherein the actuator comprises a plurality of positive pins and a plurality of negative pins; each LED comprises a positive electrode and a negative electrode; each positive electrode of a row of LEDs is connected to the corresponding positive pin; each negative electrode of a column of LEDs is connected to the corresponding negative pin, and the scanning of the LEDs comprises:

applying a voltage between one positive pin and one negative pin;

detecting a current of each of the positive pins and the negative pins; and repeating the application of the voltage until each LED is scanned.

* * * * *